US008905801B1

(12) United States Patent
Craft

(10) Patent No.: US 8,905,801 B1
(45) Date of Patent: Dec. 9, 2014

(54) MARINE OUTBOARD MOTOR

(75) Inventor: Todd D. Craft, Pleasant Prairie, WI (US)

(73) Assignee: BRP US Inc., Sturtevant, WI (US)

( * ) Notice: Subject to any disclaimer, the term of this patent is extended or adjusted under 35 U.S.C. 154(b) by 282 days.

(21) Appl. No.: 12/732,925

(22) Filed: Mar. 26, 2010

Related U.S. Application Data

(63) Continuation-in-part of application No. 12/538,573, filed on Aug. 10, 2009, now abandoned, which is a continuation of application No. 12/339,867, filed on Dec. 19, 2008, now abandoned.

(60) Provisional application No. 61/018,108, filed on Dec. 31, 2007.

(51) Int. Cl.
*B63H 20/00* (2006.01)
*F02M 35/116* (2006.01)
*F02B 75/22* (2006.01)

(52) U.S. Cl.
USPC ..... 440/53; 440/86 A; 123/54.2

(58) Field of Classification Search
USPC ..... 440/53, 88 A; 123/55.1, 54.2, 45 R, 123/195 P
See application file for complete search history.

(56) References Cited

U.S. PATENT DOCUMENTS 1,437,928 A * 12/1922 Brockway ..... 123/44 C
1,531,430 A 3/1925 Wrentmore
1,733,361 A * 10/1929 Rice, Jr. ..... 440/55
1,967,596 A * 7/1934 Schubert ..... 123/54.2
3,123,058 A * 3/1964 Wooge ..... 123/54.2
3,418,994 A 12/1968 Freyn
4,078,529 A 3/1978 Warwick
4,129,102 A 12/1978 Van Der Lely
4,194,469 A 3/1980 Kruger
4,470,379 A 9/1984 Miyakoshi et al.
4,512,291 A 4/1985 Kirk
4,685,428 A 8/1987 Inagaki et al.
4,727,794 A 3/1988 Kmicikiewicz
5,207,190 A 5/1993 Torigai et al.
5,476,402 A * 12/1995 Nakai et al. ..... 440/88 R
5,477,818 A 12/1995 Ascari et al.
5,505,166 A * 4/1996 Katoh ..... 123/41.31
5,529,029 A 6/1996 Rowe et al.
5,758,609 A 6/1998 Smith
5,873,332 A 2/1999 Taue et al.
5,875,744 A 3/1999 Vallejos
5,927,243 A 7/1999 Cikanek et al.
6,076,489 A 6/2000 Deutsch et al.
6,205,960 B1 3/2001 Vallejos (Continued)

*Primary Examiner* — Lars A Olson
*Assistant Examiner* — Andrew Polay
(74) *Attorney, Agent, or Firm* — BCF LLP

(57) ABSTRACT

A marine outboard motor comprises first and second cylinder blocks connected to a crankcase having a crankshaft. Each cylinder block contains a cylinder having a cylinder central axis, and a piston reciprocally mounted within the cylinder. First and second planes are defined by the first and second cylinder central axis and the crankshaft axis. The first and second planes are at a first angle less than 120 degrees. The exhaust manifold is at least in part within a valley formed between the first and second cylinder blocks. A configuration with a third cylinder block opposite to the first and second cylinder blocks is also described. A third plane is defined by a third cylinder central axis and the crankshaft axis. The third plane is at a second angle to the first plane and at a third angle to the second plane. The second and third angle can be equal.

18 Claims, 3 Drawing Sheets

(56) References Cited

U.S. PATENT DOCUMENTS

| | | | | |
|---|---|---|---|---|
| 7,219,632 | B2 | 5/2007 | Yamazaki | |
| 7,240,648 | B2 * | 7/2007 | Alessandrini | 123/54.1 |
| 7,383,797 | B2 | 6/2008 | Tour | |
| 2001/0054396 | A1 | 12/2001 | Hurt | |
| 2004/0237913 | A1 | 12/2004 | Nanninga | |

* cited by examiner

MARINE OUTBOARD MOTOR

CROSS-REFERENCE

This application is a continuation-in-part of U.S. patent application Ser. No. 12/538,573 filed Aug. 10, 2009, entitled, 'Marine Outboard Motor'. Through U.S. patent application Ser. No. 12/538,573, this application is also a continuation of U.S. patent application Ser. No. 12/339,867 filed Dec. 19, 2008, entitled, 'Marine Outboard Motor'. Through U.S. patent application Ser. No. 12/538,573 and Ser. No. 12/339,867, this application claims priority to U.S. Provisional Patent Application No. 61/018,108 filed Dec. 31, 2007, entitled 'Marine Outboard Motor'. The entireties of all of these applications are incorporated herein by reference.

FIELD OF THE INVENTION

The present invention relates to marine outboard motors, and particularly the engines thereof.

BACKGROUND OF THE INVENTION

Outboard motors are typically self-contained propulsion units that are mounted on the transom of a watercraft. Since their invention in the beginning of the 20$^{th}$ century—see for example U.S. Pat. No. 1,524,857 to Ole Evinrude—they have existed in many configurations. Examples of current day configurations are those motors marketed under the trademark Evinrude® (www.evinrude.com) by BRP US Inc. of Sturtevant, Wis., the assignee of the present application.

The design of engines of outboard motors differs from the design of engines of other automotive and recreational vehicles (i.e. snowmobiles, all-terrain vehicles, motorcycles, karts, personal watercraft, etc.) in several significant ways. Firstly, owing to their self-contained nature, outboard motors typically include an internal combustion engine, a transmission including a series of shafts and gears, a propulsion device (typically a propeller), structural housing for all of these parts, and external fairings covering the unit. They are mountable on and removable from the watercraft as a complete unit, and in some cases they are portable. While in use, steering, tilt and trim of the watercraft are accomplished by moving and positioning the entire unit itself. While not in use the entire unit is typically tilted so as to be out of the water in which the watercraft is located. Several outboard motors may be mounted onto the same watercraft and be in concurrent use, meaning the above functions must be accomplished without one motor interfering with any of the other motors. For all of these reasons, as persons skilled in the art of their design have recognized, outboard motors, and particularly the internal combustion engines and associated components thereof, must generally be as small and as compact in their design as possible. Much development effort has been spent over time in attempting to ensure that this is the case. In this respect, see for example, U.S. Pat. No. 5,873,332 to Taue et al. assigned to Yamaha Hatsudoki K.K. (a competitor of the assignee of the present application) and U.S. Pat. No. 5,207,190 to Torigai et al. assigned to Sanshin Kogyo K.K. (a related-entity to Yamaha). Finally, for those motors having reciprocating piston internal combustion engines, the engines are arranged in the outboard motor such that the crankshaft is vertical. In no other common vehicle engine application does this occur.

Further complicating the design of such motors is the increasing desire of users thereof for more power output per motor. For example, Yamaha Motor Corp. is currently marketing a 350 hp (261 kW) outboard motor. In order to accommodate such power output requirements and still have a reasonably compact engine design, outboard motor manufacturers have switched to what are commonly known as "V-type" engines, i.e. engines having two cylinder banks—of 2 (a "V4"), 3 (a "V6") or 4 (a "V8") aligned cylinders each—that are at an angle (usually 60 or 90 degrees) to one another. In addition to the previously referred to Evinrude® and Yamaha® outboard motors, the aforementioned '190 and '332 patents provide examples of such engines as also used in outboard motors.

In order to increase the power output still further, the addition of more cylinders to a conventional engine is required. However, the use of V8 configuration and even larger V-type configurations such as the V10 or V12 generally yields outboard motors that are unwieldy in part in that they are too long from top to bottom, creating difficulties with respect to watercraft trim and in tilting the outboard motor out of the water when not in use. Furthermore, for 2 stroke outboard engines, the tuning of the exhaust wave is greatly reduced with cylinder banks having 3 or more cylinders. Consequently the engine is less efficient and necessitates even larger displacement to generate power output. Further, although other engine configurations are known from other engine applications (usually automotive—e.g. the multi-row V-type engine of U.S. Pat. No. 6,076,489 to Deutsch et al. and the W-type engine of U.S. Patent Application Publication No. 2001/0054396 to Hurt), these engines are also generally unwieldy for marine applications in part in that they are too wide, limiting the number of engines that may be concurrently placed on the transom of the watercraft. Further they are difficult to design air intake, air exhaust, and fuel systems therefor. Improvements in engine configuration for outboard motors, particularly for higher power output engines, are therefore desirable.

Further, as is well known in the art, the reciprocal motion of the piston of an engine is translated into the rotational motion of the engine's crankshaft by a connecting rod interconnecting the two. As a result, the connecting rod's motion has both a reciprocal component and a rotational component to it. When combustion occurs in the combustion chamber the piston is forced downward in the cylinder. Because of the relationship between the geometries of the piston, the connecting rod, and the crankshaft, and the conversion of the piston's motion into the crankshaft's motion, the downward-forced piston will also be forced against the cylinder wall on the side of the cylinder on which the connecting rod is located at that point in time in the crankshaft's motion. This force against the wall of the cylinder is known in the art as the major piston side thrust, but it will simply be referred to as "piston side thrust" for the purposes of the present application.

As is also known in the art, the walls of a cylinder are not equal in terms of temperature during operation. The portion of the cylinder wall on the side of cylinder on which the exhaust port is located (i.e. the exhaust side of the cylinder) is much hotter than the portion of the cylinder wall on the side of the cylinder on which the intake port is located (i.e. the intake side of the cylinder). This is the case as the exhaust gas is much hotter than the intake gas. As the heat on the exhaust side of the cylinder tends to greatly increase wear on piston and particularly the piston rings sealing the piston against the walls of the cylinder, ideally the piston side thrust for any given cylinder would be directed against the intake side of the cylinder (to avoid exacerbating the situation and to reduce the wear on the piston on every stroke).

This is not the case, however, in V-type engines employed in conventional outboard motors, given the need for a compact engine arrangement as described above. In such engines, either the intake or the exhaust manifold is located in the valley. For example, as shown in the '190 patent, the intake manifold and the intake sides of each of the cylinders are located in the valley between the cylinders or cylinder banks. This means that for the first cylinder or bank of cylinders in the direction of rotation of the crankshaft, the piston side thrust will be against the intake side of the cylinder(s). However, for the second cylinder or bank of cylinders in the direction of rotation of the crankshaft, the piston side thrust will be against the exhaust side of the cylinder(s). U.S. Pat. No. 4,184,462 shows an example of engine where the intake manifold and the intake sides of each of the cylinders are located away from the valley, and the exhaust manifold and the exhaust sides of each of the cylinders are located in the valley between the cylinders or cylinder banks. In that case, for the first cylinder or bank of cylinders in the direction of rotation of the crankshaft, the piston side thrust will be against the exhaust side of the cylinder(s). However, for the second cylinder or bank of cylinders in the direction of rotation of the crankshaft, the piston side thrust will be against the intake side of the cylinder(s).

Heretofore, this has simply been a situation that designs (and owners) of such engines have had to live with. Improvement would be desirable.

Therefore, there is a need for in the art for a marine outboard motor having an improved engine configuration.

STATEMENT OF THE INVENTION

It is therefore an object of the present invention to ameliorate at least one of the inconveniences present in the prior art.

It is also an object of the present invention to provide a marine outboard motor having an improved engine configuration.

In one aspect, the invention thus provides a marine outboard motor comprising a cowling. An engine is disposed at least in part in the cowling. The engine includes a crankcase fixedly mounted to an engine support, the crankcase having a crankcase chamber therein. A crankshaft is rotatably disposed within the crankcase chamber so as to be capable of rotation about a generally vertical crankshaft axis in a first direction. A first cylinder block is connected to the crankcase. A first cylinder head is connected to the first cylinder block. A first cylinder is formed by the first cylinder block and the first cylinder head. A first piston is reciprocally mounted within the first cylinder and forming a first variable volume combustion chamber therein. The first piston is connected to the crankshaft via a first connecting rod. At least one first intake port is fluidly connected to the first combustion chamber for allowing at least one combustion component to enter the first combustion chamber. At least one first exhaust port is fluidly connected to the first combustion chamber for allowing spent combustion components to exit the first combustion chamber. The first cylinder has a first cylinder central axis.

A second cylinder block is connected to the crankcase. A second cylinder head is connected to the second cylinder block. A second cylinder is formed by the second cylinder block and the second cylinder head. A second piston is reciprocally mounted within the second cylinder and forming a second variable volume combustion chamber therein. The second piston is connected to the crankshaft via a second connecting rod. At least one second intake port is fluidly connected to the second combustion chamber for allowing at least one combustion component to enter the second combustion chamber. At least one second exhaust port is fluidly connected to the second combustion chamber for allowing spent combustion components to exit the second combustion chamber. The second cylinder has a second cylinder central axis.

A first plane is defined by the first cylinder central axis and the crankshaft axis and a second plane defined by the second cylinder central axis and the crankshaft axis being at a first angle of not greater than 120 degrees to one another. The first cylinder block and the second cylinder block form a valley therebetween. An intake manifold is fluidly connected to the first intake port of the first combustion chamber of the first cylinder. The first direction of rotation of the crankshaft is such that during operation of the engine a first piston side thrust against the first cylinder block is generally towards the valley. An exhaust manifold is fluidly connected to the second exhaust port of the second combustion chamber of the second cylinder. The exhaust manifold is located at least in part within the valley between the first and the second cylinder blocks. The first direction of rotation of the crankshaft is such that during operation of the engine a second piston side thrust against the second cylinder block is generally away from the valley.

A housing is connected to the engine support. A driveshaft is disposed generally vertically in the housing. The driveshaft has a first end and a second end. The first end of the driveshaft is operatively connected to the crankshaft. A gear case is connected to the housing. A rotor shaft is disposed at least in part in the gear case generally perpendicular to the driveshaft. The rotor shaft is operatively connected to the second end of the driveshaft. A bladed rotor is connected to the rotor shaft.

In this first aspect, the engine has been designed such that the piston side thrust of the piston of each cylinder (and not just the first cylinder in the direction of rotation of the engine) is against the intake side of that cylinder. Given that the engine is a V-type engine, this has resulted in the reversal of the location of the intake and exhaust ports of the second cylinder (in the direction of the crankshaft rotation). Indeed, the prior art teaches that only one of the exhaust and intake manifold is located in the valley. Therefore, similar to a conventional V-type engine, the at least one intake port of the first cylinder is located within the valley of the engine. However, opposite to a conventional V-type engine, it is the at least one exhaust port of the second cylinder and exhaust manifold connected to that port of that cylinder that is located within the valley of the engine. The at least one intake port of the second cylinder and the intake manifold associated therewith are outside the valley of the engine, located where the at least one exhaust port and exhaust manifold would be located on a conventional V-type engine.

The above description refers to the situation where the engine is a two cylinder V-type engine (commonly known as a "V-twin"). Preferably, however, the first cylinder is one of a first plurality of cylinders forming a first cylinder bank, each cylinder of the first cylinder bank having its cylinder central axis lying in the first plane; and the second cylinder is one of a second plurality of cylinders forming a second cylinder bank, each cylinder of the second cylinder bank having its cylinder central axis lying in the second plane. In such cases, it is preferred that the first plurality of cylinders and the second plurality of cylinders both consist of 2 cylinders each (such that the engine is a V4) or both consist of 3 cylinders each (such that the engine is a V6). (It is foreseeable that the present invention could be embodied in engines have a greater number of cylinders, e.g. a V8, but these configurations are less preferred). In each of these cases, as was the case with the V-twin, there is a reversal of the location of the intake and exhaust ports of the cylinders of the second cylinder bank (in the direction of the crankshaft rotation). Thus, similar to a conventional V-type multiple cylinder bank engine, the intake ports of the cylinders of the first bank are located within the valley of the engine. However, opposite to a conventional V-type multiple cylinder bank engine, it is the exhaust ports of the cylinders of the second bank and the exhaust manifold connected to those ports that are located within the valley of the engine. The intake ports of the cylinders of the second bank and the intake manifold associated therewith are outside the valley of the engine, located where the exhaust ports and exhaust manifold would be located on a conventional V-type multiple cylinder bank engine.

For certain outboard motor applications, the intake manifold associated with the first cylinder is located at least in part within the valley between the first and the second cylinder blocks. It is preferred that an insulant be disposed within the valley so as to (significantly) reduce or effectively eliminate (as much as possible) heat transfer from the intake manifold to the exhaust manifold. (For the purposes of the present application, an "insulant" is any material that insulates against heat transfer). As is known to those skilled in the art, the cooler the intake gases are in a cylinder the more efficient the combustion and therefore the more power produced. An insulant is therefore preferably present to prevent (as much as possible) the intake gases for the first cylinder from being warmed by the exhaust gases of the second cylinder. Conventional V-type engines do not normally have this problem as only intake manifold or the exhaust manifold is located within the valley of the engine. Irrespective of whether an insulant is present, it is also preferred that the intake manifold and the exhaust manifold in the valley are structured and arranged one with respect to the other to reduce heat transfer therebetween. For example, the manifolds may be shaped and located one with respect to the other such that the space in which they are close to one another is minimized.

In some embodiments, the intake manifold is a first intake manifold; and a second intake manifold is fluidly connected to the at least second intake port of the second combustion chamber of the second cylinder. The second intake manifold is not located in the valley.

In other embodiments, each of the at least first and second intake ports is further fluidly connected to at least a portion of the crankcase chamber and the at least one combustion component is compressed in the crankcase chamber before flowing through one of the at least first and second intake ports and entering a corresponding first and second combustion chambers.

In some embodiments, the intake manifold is shared by the cylinders of the first cylinder bank, and the exhaust manifold is shared by the cylinders of the second cylinder bank.

For certain outboard motor applications, whether the engine is a V-twin or multiple cylinder bank V-type engine, it is preferred that the first angle (i.e. the angle between the first and the second planes) is not greater than 90 degrees and more preferably is 90 degrees. For other outboard motor applications it is preferred that the first angle is not greater than 74 degrees and more preferably is 74 degrees. For some applications it is also preferred that the first angle is not greater than 60 degrees and more preferably is 60 degrees. As is known in the art, typically the angle between the cylinders (or cylinder banks—as the case may be) is dictated in part by design choice and in part by other engine design considerations such as mass balancing, cylinder volume and piston displacement of the cylinders.

For certain outboard motor applications, it is preferred that the engine further comprises a third cylinder block connected to the crankcase on an opposite side of the engine from the first cylinder block and the second cylinder block. A third cylinder head is connected to the third cylinder block. A third cylinder is formed by the third cylinder block and the third cylinder head. A third piston is reciprocally mounted within the third cylinder and forms a third variable volume combustion chamber. The third piston is connected to the crankshaft via a third connecting rod. At least one third intake port is fluidly connected to the third combustion chamber for allowing at least one combustion component to enter the third combustion chamber. At least one third exhaust port is fluidly connected to the third combustion chamber for allowing spent combustion components to exit the third combustion chamber. The third cylinder has a third cylinder central axis, the third cylinder central axis being between a portion of the first plane and a portion of the second plane on a side of the engine on which the third cylinder block is located.

This aspect of the present invention may be referred to as the "Y-type engine", as the engine has a third cylinder located on an opposite side of the engine from the cylinders of the "V" such that the third cylinder central axis is between a portion of the first plane and a portion of the second plane on a side of the engine on which the third cylinder block is located. Motors having a V8 configuration are reaching their limit in power output. A marine outboard motor is believed to be particularly if not uniquely suited to use a Y-type engine as the engine is oriented such that the crankshaft is vertical. This new configuration provides a compact engine that has an increased level of power output as compared with conventional designs.

This would not, however, be the same situation at all on an automotive or recreational vehicle. On these vehicles, the engine is oriented with its crankshaft being horizontal and with the cylinders directed upwards. A Y-type engine would not be employed on such a vehicle as it would require the third cylinder to be upside-down in the vehicle, under which conditions the cylinder would not function at all (gravity being important to the functioning of the cylinder) or would require substantial complex design modifications (with respect to the other two cylinders) to function. Further, even if such modifications were to be carried out, it would be very difficult to perform maintenance on such an engine in such a vehicle, as access to the third cylinder would be limited at best (on an automobile perhaps), or non-existent (without removing the engine in its entirety) at worst (as an inboard engine on a watercraft). In some cases, the vehicle in which such an engine would be proposed to be located would have to be redesigned as well. Hence Y-type engines are not likely to exist outside of marine outboard motors (which as described hereinabove, owing to their vertical crankshaft orientation, do not present them same design challenges as to do other vehicles).

In cases where the engine is of the Y-type, it is preferred (although not required) that the intake ports of each of the combustion chambers of the cylinders are located with respect to the first direction of rotation of the crankshaft such that during operation of the engine the piston side thrust of each of the pistons against its respective cylinder block is generally towards an intake port side of its respective cylinder. The aforementioned piston side thrust issue having been resolved with respect to the first two cylinders, in most cases the issue should not be re-created with respect to the third cylinder.

The above description of the Y-type engine refers to the situation where the engine is a three cylinder Y-type engine (which, by analogy to the V-type engine, may be referred to as a "Y-triple"). In situations where more power output is required, it may be preferred that the first cylinder is one of a first plurality of cylinders forming a first cylinder bank, each cylinder of the first cylinder bank having its cylinder central axis lying in the first plane; the second cylinder is one of a second plurality of cylinders forming a second cylinder bank, each cylinder of the second cylinder bank having its cylinder central axis lying in the second plane; and the third cylinder is one of a third plurality of cylinders forming a third cylinder bank, each cylinder of the third cylinder bank having its cylinder central axis lying the third plane. In such cases, it is preferred that the first plurality of cylinders, the second plurality of cylinders, and the third plurality of cylinders all consist of 2 cylinders (such that the engine is a Y6) each or all consist of 3 cylinders each (such that the engine is a Y9). It is also foreseeable that the present invention could be embodied in engines have a greater number of cylinders, e.g. a Y12 and Y15. Again, it is preferred (although not required) that the intake ports of each of the combustion chambers of each of the cylinders of each of the cylinder banks are located with respect to the first direction of rotation of the crankshaft such that during operation of the engine the piston side thrust of each of the pistons against its respective cylinder block is generally towards an intake port side of its respective cylinder.

Preferably for certain outboard motor applications, the first angle (i.e. the angle between the first and the second planes) is not greater than 90 degrees and more preferably is 90 degrees. For other outboard motor applications it is preferred that the first angle is not greater than 74 degrees and more preferably is 74 degrees. For some applications it is also preferred that the first angle is not greater than 60 degrees and more preferably is 60 degrees. By analogy to the V-type engines, it is believed the angle between the "V-cylinders" of the Y-type engine (or "V-cylinder banks"—as the case may be) will be similarly dictated in part by design choice and in party by other engine design considerations such as mass balancing, cylinder volume and piston displacement of the cylinders, in the same manner as it is for conventional V-type engines. In either case, it is preferred that a third plane is defined by the third cylinder central axis and the crankshaft axis and the third plane is at a second angle to the first plane and at a third angle to the second plane, and that the second angle and the third angle are equal. This relationship is preferred in order that when the outboard motor is mounted on the transom of a watercraft and is steered straight, the motion of the piston in the third cylinder will be in a plane parallel to the central longitudinal plane of the watercraft (so as to minimize the effect of engine vibration on the watercraft).

In some embodiments, both the intake manifold and the exhaust manifold are located in the valley of the engine between the cylinders (if the engine is a V-type) or the "V-cylinders" (if the engine is a Y-type). In an embodiment, the intake and exhaust manifold in the valley are separated by an insulant.

In some embodiments, each of the first, second and third cylinder has an associated intake manifold.

In other embodiments, each of the first, second and third cylinder has an associated exhaust manifold.

An engine constructed according to the teachings of the present invention may operate on a 2-stroke principle or on a 4-stroke principle. In either case, and as is commonly the case in 2-stroke engines, the intake ports may be further fluidly connected to at least a portion of the crankcase chamber and the at least one combustion component (e.g. air alone or an air-fuel mixture) is compressed in the crankcase chamber before flowing through one of the intake ports and entering a respective one of the combustion chambers. It should be understood that in such cases, the "intake port" of the present invention, refers to the port that through which the at least one combustion component actually enters the combustion chamber itself and not simply the engine. I.e. for the purposes of the present invention, in such engines, that which is typically known as a transfer port (as it transfers compressed gasses from the crankcase chamber to the combustion chamber) or sometimes a scavenge port, will be considered to be the intake port.

In some embodiments, each cylinder bank has a shared intake manifold and a shared exhaust manifold.

In other embodiments, the valley is a first valley and the exhaust manifold is a first exhaust manifold. A second valley is formed between the second and the third cylinders, and a third valley is formed between the third and the first cylinders. A second exhaust manifold fluidly connects the second cylinder, and a third exhaust manifold fluidly connects the third cylinder. Each of the first, second and third valleys has only one of the first, second and third exhaust manifold.

It is preferred that each of the cylinder blocks or cylinder banks of the engine have substantially the same configuration. More specifically, in order to minimize the number of different parts required for engine assembly and in order to reduce the complexity of engine assembly, the cylinder blocks, cylinder heads, pistons, connecting rods, intake ports and exhaust ports of the engine have substantially the same configuration. More preferably they are identical. For similar reasons, it is also preferred that the intake manifold and exhaust manifolds of the engine have substantially the same configuration, and more preferably are identical as well (i.e. each intake manifold is the same as every other intake manifold and each exhaust manifold is the same as every other exhaust manifold, but not necessarily that the intake manifolds and the exhaust manifolds are the same as each other).

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
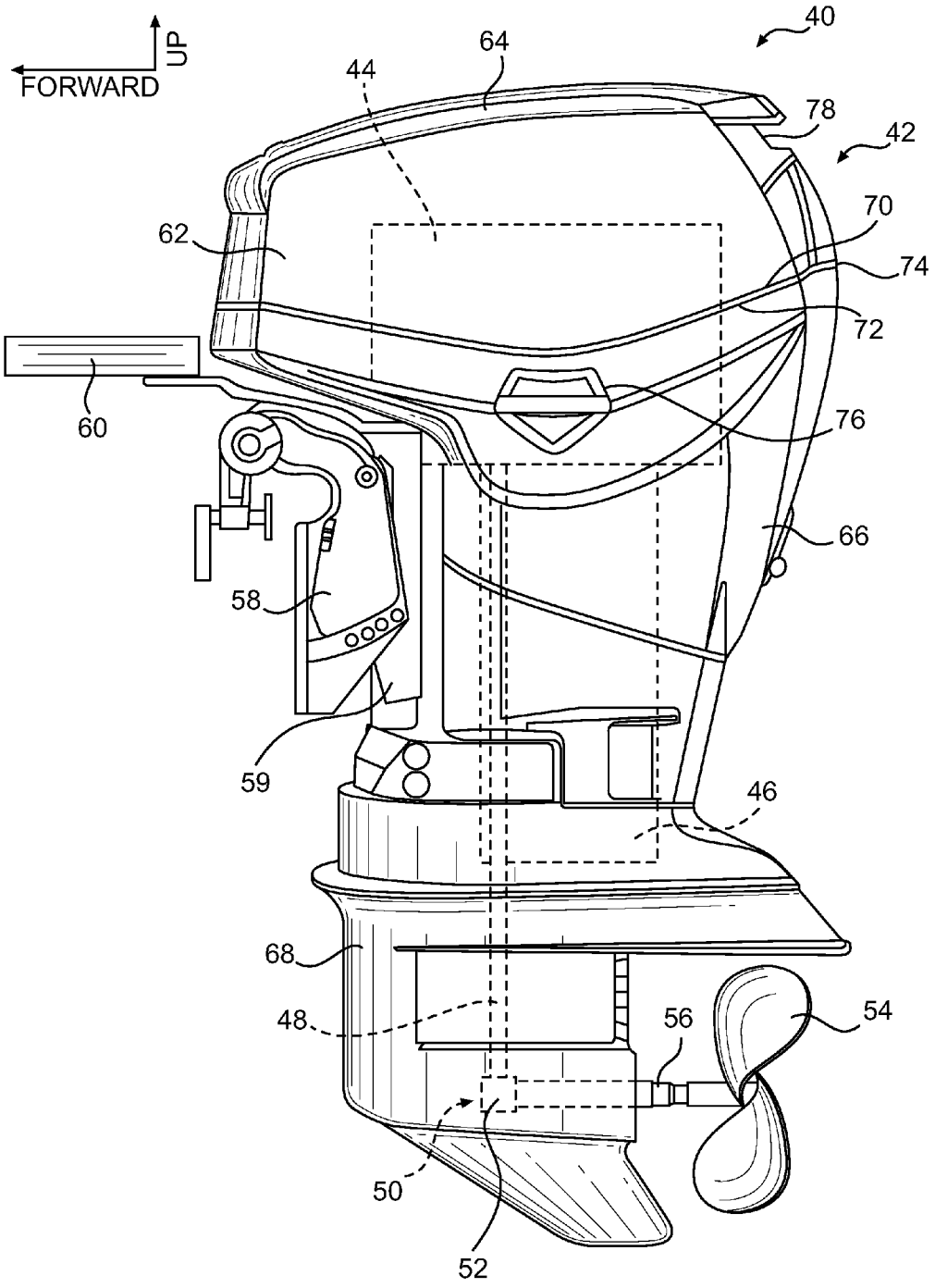
FIG. 1 is a left side view of a marine outboard motor of the present invention.

Referring to FIG. 1, a marine outboard motor 40 has a cowling 42. The cowling 42 surrounds and protects an engine 44, shown schematically, and described in further detail herein below. An exhaust system 46 for the motor 40, shown schematically, is connected to the engine 44 and is also surrounded by the cowling 42.

The engine 44 is coupled to a vertically oriented driveshaft 48. The driveshaft 48 is coupled to a drive mechanism 50, which includes a transmission 52 and a bladed rotor (in this case propeller 54) mounted on a propeller shaft 56. The propeller shaft 56 is generally perpendicular to the driveshaft 48. The drive mechanism 50 could also include a jet propulsion device, turbine or other known propelling device. The bladed rotor could also be an impeller. Other known components of an engine assembly are included within the cowling 42, such as a starter motor and an alternator. As it is believed that these components would be readily recognized by one of ordinary skill in the art, further explanation and description of these components will not be provided herein.

A stern bracket 58 is connected to the cowling 42 via the swivel bracket 59 for mounting the outboard motor 40 to a watercraft. The stern bracket 58 can take various forms, the details of which are conventionally known. The swivel bracket 59 houses a steering shaft of the outboard motor 40.

A tiller 60 is operatively connected to the cowling 42 to allow manual steering of the outboard motor 40. It is contemplated that other conventional steering mechanisms could be provided to allow steering, such as the steering wheel of a boat.

The cowling 42 includes several primary components, including an upper motor cover 62 with a top cap 64, and a lower motor cover 66. A lowermost portion, commonly called the gear case 68, is attached to the exhaust housing 69 (not shown) which forms part of the exhaust system 46. The upper motor cover 62 preferably encloses the top portion of the engine 44. The lower motor cover 66 surrounds the remainder of the engine 44 and the exhaust system 46. The gear case 68 encloses the transmission 52 and supports the drive mechanism 50, in a known manner. The propeller shaft 56 extends from the gear case 68 and supports the propeller 54.

The upper motor cover 62 and the lower motor cover 66 are made of sheet material, preferably plastic, but could also be metal, composite or the like. The lower motor cover 66 and/or other components of the cowling 42 can be formed as a single piece or as several pieces. For example, the lower motor cover 66 can be formed as two lateral pieces that mate along a vertical joint. The lower motor cover 66, which is also made of sheet material, is preferably made of composite, but could also be plastic or metal. One suitable composite is fiberglass.

A lower edge 70 of the upper motor cover 62 mates in a sealing relationship with an upper edge 72 of the lower motor cover 66. A seal 74 is disposed between the lower edge 70 of the upper motor cover 62 and the upper edge 72 of the lower motor cover 66 to form a watertight connection.

A locking mechanism 76 is provided on at least one of the sides of the cowling 42. Preferably, locking mechanisms 76 are provided on each side of the cowling 10.

The upper motor cover 62 is formed with two parts, but could also be a single cover. As seen in FIG. 1, the upper motor cover 62 includes an air intake portion 78 formed as a recessed portion on the rear of the cowling 42. The air intake portion 78 is configured to prevent water from entering the interior of the cowling 42 and reaching the engine 44. Such a configuration can include a tortuous path. The top cap 64 fits over the upper motor cover 62 in a sealing relationship and preferably defines a portion of the air intake portion 78. Alternatively, the air intake portion 78 can be wholly formed in the upper motor cover 62 or even the lower motor cover 66.

Figure 2:
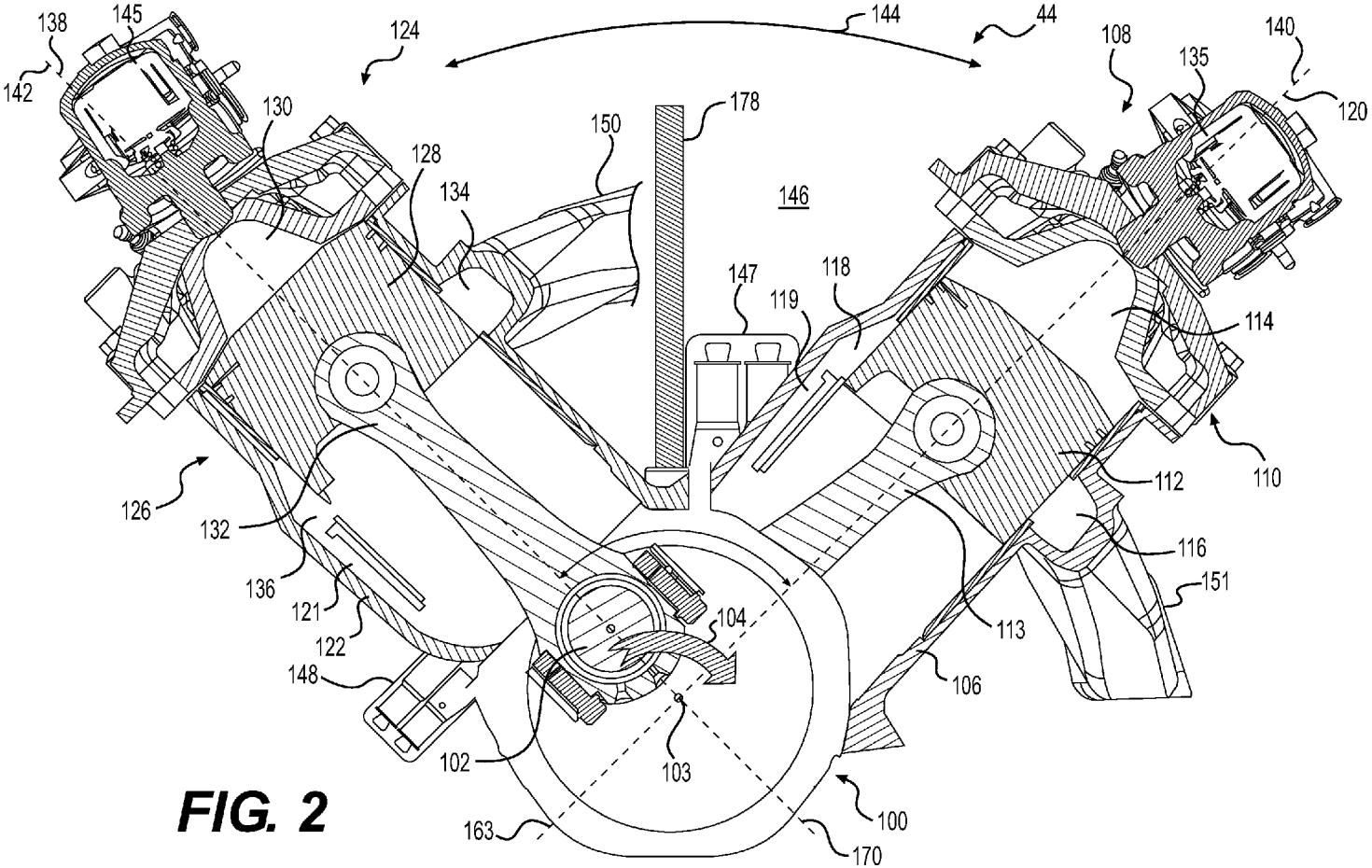
FIG. 2 is a cross sectional view of a marine outboard motor according to an embodiment of the invention.
Figure 3:
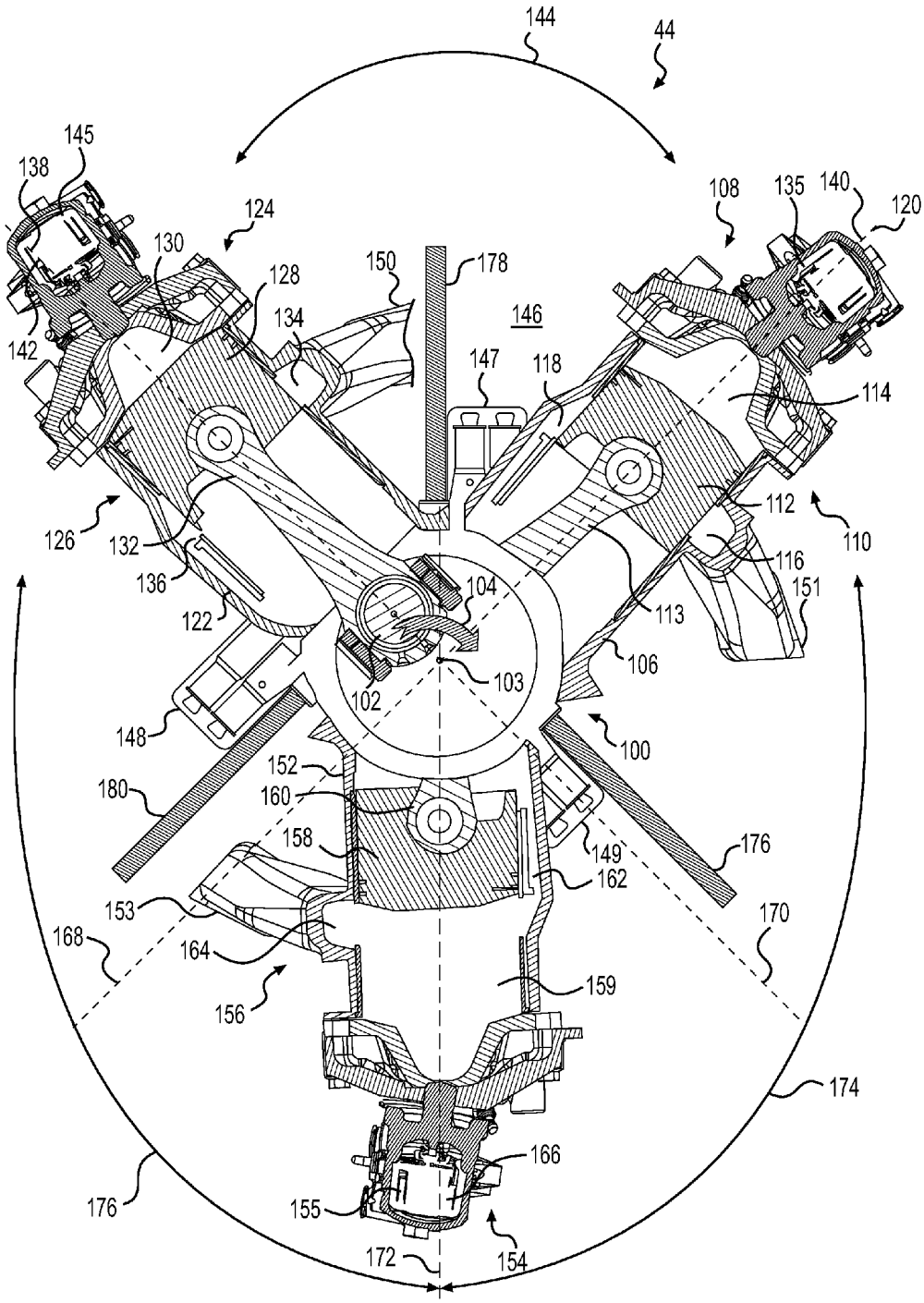
FIG. 3 is a cross sectional view of a marine outboard motor according to another embodiment of the invention.

In FIG. 2, the engine 44 is a V6 engine having three cylinder banks in a V-type arrangement operating on a two-stroke crankcase compression principle, while in FIG. 3, the engine 44 is a Y9 engine having three cylinder banks in a Y-type arrangement operating on a two-stroke crankcase compression principle. For ease of reference, there is shown a schematic of one set of cylinders (one from each bank) of the engine 44. Specifically the engine 44 has a crankcase 100 that is fixedly mounted to an engine support (not shown, an example of engine support is provided in U.S. Provisional Patent Application 60/947,101, filed Jun. 29, 2007, entitled 'Engine Mount System for a Marine Outboard Engine', incorporated herein by reference), itself being a portion of the exhaust housing 69. Supported within the crankcase 100 by conventional means in a vertical orientation is a crankshaft 102 capable of a rotational motion about a crankshaft axis 103 in a first direction 104. The crankshaft 102 is operatively connected to the driveshaft 48 of the outboard motor 40.

A first cylinder 110 is formed by the cooperation of a first cylinder block 106 connected to the crankcase 100 and a first cylinder head 108 connected to the first cylinder block 106. A first piston 112 is reciprocally mounted within the first cylinder 110 to form a first variable volume combustion chamber 114. The first piston 112 is connected to the crankshaft 102 by a first connecting rod 113. A first intake port 118 is fluidly connected to the first combustion chamber 114 to allow for the entrance of at least one combustion component in the combustion chamber 114. The engine is a 2-stroke direct injection engine, so generally the sole combustion component entering the combustion chamber 114 via the intake port 118 is air. Fuel will be directly injected into the cylinder 110 by a fuel injector 135 having an outlet into the combustion chamber 114. However, it is contemplated that fuel could be injected into the cylinder 110 indirectly by being injected into the intake runner that channels air to the cylinder 110 during the intake stroke. A first exhaust port 116 is fluidly connected to the first combustion chamber 114 to allow for the exit of spent combustion components from the combustion chamber 114. The first cylinder 110 has a first cylinder central axis 120.

A second cylinder 126 is formed by the cooperation of a second cylinder block 122 connected to the crankcase 100 and a second cylinder head 124 connected to the second cylinder block 122. A second piston 128 is reciprocally mounted within the second cylinder 126 to form a second variable volume combustion chamber 130. The second piston 128 is connected to the crankshaft 102 by a second connecting rod 132. A second intake port 136 is fluidly connected to the second combustion chamber 130 to allow for the entrance of at least one combustion component in the combustion chamber 130. The engine is a 2-stroke direct injection engine, so generally the sole combustion component entering the combustion chamber 130 via the intake port 136 is air. Fuel will be directly injected into the cylinder 126 by a fuel injector 145 having an outlet into the combustion chamber 130. However, it is contemplated that fuel could be injected into the cylinder 126 indirectly by being injected into the intake runner that channels air to the cylinder 126 during the intake stroke. A second exhaust port 134 is fluidly connected to the second combustion chamber 130 to allow for the exit of spent combustion components from the combustion chamber 130. The second cylinder 126 has a second cylinder central axis 138.

A first plane 140 (shown as a line in FIGS. 2 and 3) is defined by the first cylinder central axis 120 and the crankshaft axis 103. A second plane 142 is defined by the second cylinder central axis 138 and the crankshaft axis 103. The first plane 140 and the second plane 142 are at a first angle 144 of 90 degrees to one another. In some embodiments, the first angle 144 is of 74 degrees. It is contemplated that the first angle 144 could be different, yet below 74 degrees. The first cylinder block 106 and the second cylinder block 122 form a valley 146 between them.

An intake manifold 147 associated with the crankcase 100 is located in the valley 146 and is fluidly connected to the first intake port 118 of the first cylinder 110. The intake manifold 147 takes air from the environment and feeds it to the crankcase 100. The motion of the crankcase 100 pressurizes the air which is then fed through the intake port 118 via passages 119. The direction of rotation 104 of the crankshaft 102 and the location of the first inlet port 118 and the first exhaust port 116 is such that the piston side thrust of the first piston 112 is against the intake side of the cylinder 110. An exhaust manifold 151 (only a portion being shown in FIG. 3) is associated with the first exhaust port 116. It is contemplated that the intake manifold 147 could be located elsewhere on the crankcase 100 away from the valley 146, such as under the crankcase 100. An exhaust manifold 150 (only a portion being shown) associated with the second cylinder 122 is located in the valley 146 and is fluidly connected to the second exhaust port 134 of the second cylinder 122. The direction of rotation 104 of the crankshaft 102 and the location of the second inlet port 136 and the second exhaust port 134 is such that the piston side thrust of the second piston 128 is against the intake side of the cylinder 122. The intake manifold 148 is associated with the second intake port 136. It is also contemplated that the intake manifold 148 could be shared with the intake manifold 147 via the open volume of the crankcase 100.

An insulant 178 is located in the valley 146 and positioned between the intake manifold 147 associated with the first cylinder 110 and the exhaust manifold 150 associated with the second cylinder 122. The intake manifold 147 and the exhaust manifold 150 associated with the second cylinder 122 are structured and arranged one with respect to the other so as to minimize heat transfer therebetween. It is contemplated that the insulant 178 could be removed. In such case, the intake manifold 147 and the exhaust manifold 150 are shaped and located such that heat transfer between them is minimized. It is also contemplated that no insulant 178 would likely be needed if the intake manifold 147 were to be located elsewhere on the crankcase 100 away from the valley 146, such as under the crankcase 100.

Referring more specifically to FIG. 3, the engine 44 being a Y9 engine having three cylinder banks in a Y-type arrangement operating on a two-stroke crankcase compression principle will be described. The engine 44 having three cylinder banks has the first cylinder 110 and the second cylinder 126 similar to what has been described above with respect to the V-type arrangement, and will therefore not be repeated here. A third cylinder 156 is located on the opposite side of the engine 44 from the first cylinder 110 and the second cylinder 122. The third cylinder 156 is formed by the cooperation of a third cylinder block 152 connected to the crankcase 100 and a third cylinder head 154 connected to the third cylinder block 152. A third piston 158 is reciprocally mounted within the third cylinder 156 to form a third variable volume combustion chamber 159. The third piston 158 is connected to the crankshaft 102 by a third connecting rod 160. A third intake port 162 is fluidly connected to the third combustion chamber 159 to allow for the entrance of at least one combustion component in the combustion chamber 159. (In the present case, the engine is a 2-stroke direct injection engine, so generally the sole combustion component entering the combustion chamber 159 via the intake port 164 is air. Fuel will be directly injected into the cylinder 156 by a fuel injector 155 having an outlet into the combustion chamber 159). A third exhaust port 164 is fluidly connected to the third combustion chamber 159 to allow for the exit of spent combustion components from the combustion chamber 159. The direction of rotation 104 of the crankshaft 102 and the location of the third inlet port 164 and the third exhaust port 164 is such that the piston side thrust of the third piston 158 is against the intake side of the cylinder 156. The intake manifold 149 is associated with the intake port 162 of the third cylinder 156. An exhaust manifold 153 (only a portion being shown) is associated with the exhaust port 164 of the third cylinder 156. It is also contemplated that the intake manifold 149 of the third cylinder 156 could be not present and that the intake port 162 could be associated with the manifold 147. The intake manifold 149 of the third cylinder 156 and the exhaust manifold 151 of the first cylinder 110 are separated by an insulant 176. It is contemplated that the insulant 176 could be omitted. The intake manifold 148 of the second cylinder 126 and the exhaust manifold 153 of the third cylinder 156 are separated by an insulant 180. It is contemplated that the insulant 180 could be omitted.

The third cylinder 156 has a third cylinder central axis 166. The third cylinder central axis 166 lies between a portion 168 of the first plane 140 on the side of the engine 44 on which the third cylinder 156 is located and a portion 170 of the second plane 142 on the side of the engine 44 on which the third cylinder 156 is located.

A third plane 172 (shown as a line in FIG. 3) is defined by the third cylinder central axis 166 and the crankshaft axis 103. The first plane 140 and the third plane 172 are at a second angle 174 of 135 degrees to one another. The second plane 142 and the third plane 172 are at a third angle 176 of 135 degrees to one another. In an alternative embodiment, the third angle 176 is 150 degrees, and the second angle 174 is 120 degrees. In another alternative embodiment, the third angle 176 is 145 degrees, and the second angle 174 is 125 degrees.

Each of the cylinder blocks 106, 122, 152, cylinder heads 108, 124, 154, pistons 112, 128, 158, connecting rods 113, 132, 160, intake ports 118, 136, 162, and exhaust ports 116, 134, 164 of the engine 44, intake manifolds 147, 148, 149 and exhaust manifolds have substantially the same configuration. It is contemplated that they could have different configurations in different embodiments.

The cylinder blocks 106, 122, 152 and the crankcase 100 could be integrally formed, such as a moulded block, or could be formed of 2 or 3 separable portions.

A person skilled in the art would appreciate that the engine 44 comprises all the other features and components that such a conventional outboard motor entails. An example of such features and components are described U.S. patent application Ser. No. 11/960,543, filed Dec. 19, 2007, entitled 'Internal Combustion Engine Cam Follower Arrangement' incorporated herein by reference.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

The invention claimed is:

1. A marine outboard motor comprising:

a cowling;

an engine disposed at least in part in the cowling, the engine including:

a crankcase fixedly mounted to an engine support, the crankcase having a crankcase chamber therein, a crankshaft rotatably disposed within the crankcase chamber so as to be capable of rotation about a generally vertical crankshaft axis in a first direction, a first cylinder block connected to the crankcase, a first cylinder head connected to the first cylinder block, a first cylinder formed by the first cylinder block and the first cylinder head, a first piston reciprocally mounted within the first cylinder and forming a first variable volume combustion chamber therein, the first piston being connected to the crankshaft via a first connecting rod, at least one first intake port fluidly connected to the first combustion chamber for allowing at least one combustion component to enter the first combustion chamber, at least one first passage within the first cylinder block connecting the crankcase chamber with the at least one first intake port;

at least one first exhaust port fluidly connected to the first combustion chamber for allowing spent combustion components to exit the first combustion chamber, the first cylinder having a first cylinder central axis, a second cylinder block connected to the crankcase, a second cylinder head connected to the second cylinder block, a second cylinder formed by the second cylinder block and the second cylinder head, a second piston reciprocally mounted within the second cylinder and forming a second variable volume combustion chamber therein, the second piston being connected to the crankshaft via a second connecting rod, at least one second intake port fluidly connected to the second combustion chamber for allowing at least one combustion component to enter the second combustion chamber, at least one second passage within the second cylinder block connecting the crankcase chamber with the at least one second intake port, at least one second exhaust port fluidly connected to the second combustion chamber for allowing spent combustion components to exit the second combustion chamber, the second cylinder having a second cylinder central axis, a first plane defined by the first cylinder central axis and the crankshaft axis and a second plane defined by the second cylinder central axis and the crankshaft axis being at a first angle of not greater than 120 degrees to one another, the first cylinder block and the second cylinder block forming a valley therebetween, an intake manifold fluidly connected to the at least one first intake port of the first combustion chamber of the first cylinder, the first direction of rotation of the crankshaft being such that during operation of the engine during a down-stroke of the first piston a side thrust of the first piston against the first cylinder block is generally towards a side of the first combustion chamber on which the at least one first intake port is located, an exhaust manifold fluidly connected to the at least one second exhaust port of the second combustion chamber of the second cylinder, the exhaust manifold being located at least in part within the valley between the first and the second cylinder blocks, the first direction of rotation of the crankshaft being such that during operation of the engine during a down-stroke of the second piston a side thrust of the second piston against the second cylinder block is generally away from a side of the second combustion chamber on which the at least one second exhaust port is located, and wherein the at least one combustion component is compressed in the crankcase chamber by the first piston before flowing through the at least one first passage and the at least one first intake port and entering the first chamber, and wherein the at least one combustion component is compressed in the crankcase chamber by the second piston before flowing through the at least one second passage and the at least one second intake port and entering the second combustion chamber;

a housing connected to the engine support;

a driveshaft disposed generally vertically in the housing, the driveshaft having a first end and a second end, the first end of the driveshaft being operatively connected to the crankshaft; a gear case connected to the housing;

a rotor shaft disposed at least in part in the gear case generally perpendicular to the driveshaft, the rotor shaft being operatively connected to the second end of the driveshaft; and a bladed rotor connected to the rotor shaft.

2. The marine outboard motor of claim 1, wherein the intake manifold is located at least in part within the valley between the first and the second cylinder blocks.

3. The marine outboard motor of claim 2, further comprising an insulant disposed within the valley for reducing heat transfer between the intake manifold and the exhaust manifold.

4. The marine outboard motor of claim 1, wherein the intake manifold is a first intake manifold; and further comprising a second intake manifold fluidly connected to the at least second intake port of the second combustion chamber of the second cylinder.

5. The marine outboard motor of claim 1, wherein the exhaust manifold is a first exhaust manifold; and further comprising a second exhaust manifold fluidly connected to the second cylinder, the first and second exhaust manifolds the engine having the same configuration.

6. A marine outboard motor comprising:

a cowling;

an engine disposed at least in part in the cowling, the engine including:

a crankcase fixedly mounted to an engine support, the crankcase having a crankcase chamber therein, a crankshaft rotatably disposed within the crankcase chamber so as to be capable of rotation about a generally vertical crankshaft axis in a first direction, a first cylinder block connected to the crankcase, a first cylinder head connected to the first cylinder block, a first cylinder formed by the first cylinder block and the first cylinder head, a first piston reciprocally mounted within the first cylinder and forming a first variable volume combustion chamber therein, the first piston being connected to the crankshaft via a first connecting rod, at least one first intake port fluidly connected to the first combustion chamber for allowing at least one combustion component to enter the first combustion chamber, at least one first exhaust port fluidly connected to the first combustion chamber for allowing spent combustion components to exit the first combustion chamber, the first cylinder having a first cylinder central axis, a second cylinder block connected to the crankcase, a second cylinder head connected to the second cylinder block, a second cylinder formed by the second cylinder block and the second cylinder head, a second piston reciprocally mounted within the second cylinder and forming a second variable volume combustion chamber therein, the second piston being connected to the crankshaft via a second connecting rod, at least one second intake port fluidly connected to the second combustion chamber for allowing at least one combustion component to enter the second combustion chamber, at least one second exhaust port fluidly connected to the second combustion chamber for allowing spent combustion components to exit the second combustion chamber, the second cylinder having a second cylinder central axis, a first plane defined by the first cylinder central axis and the crankshaft axis and a second plane defined by the second cylinder central axis and the crankshaft axis being at a first angle of not greater than 120 degrees to one another, the first cylinder block and the second cylinder block forming a valley therebetween, an intake manifold fluidly connected to the at least one first intake port of the first combustion chamber of the first cylinder, the first direction of rotation of the crankshaft being such that during operation of the engine during a down-stroke of the first piston a side thrust of the first piston against the first cylinder block is generally towards a side of the combustion chamber on which the intake port is located, an exhaust manifold fluidly connected to the at least one second exhaust port of the second combustion chamber of the second cylinder, the exhaust manifold being located at least in part within the valley between the first and the second cylinder blocks, the first direction of rotation of the crankshaft being such that during operation of the engine during a down-stroke of the second piston a side thrust of the second piston against the second cylinder block is generally away from a side of the combustion chamber of which the exhaust port is located, and wherein the first cylinder is one of a first plurality of cylinders forming a first cylinder bank, each cylinder of the first cylinder bank having its cylinder central axis lying in the first plane, the cylinders of the first cylinder bank being arranged in a first line parallel to the crankshaft axis, and the second cylinder is one of a second plurality of cylinders forming a second cylinder bank, each cylinder of the second cylinder bank having its cylinder central axis lying in the second plane, the cylinders of the second cylinder bank being arranged in a second line parallel to the crankshaft axis;

a housing connected to the engine support;

a driveshaft disposed generally vertically in the housing, the driveshaft having a first end and a second end, the first end of the driveshaft being operatively connected to the crankshaft; a gear case connected to the housing;

a rotor shaft disposed at least in part in the gear case generally perpendicular to the driveshaft, the rotor shaft being operatively connected to the second end of the driveshaft; and a bladed rotor connected to the rotor shaft.

7. The marine outboard motor of claim 6, wherein the intake manifold is a first intake manifold fluidly connected to intake ports of combustion chambers of each of the first plurality of cylinders forming the first cylinder bank; and further comprising a second intake manifold fluidly connected to intake ports of combustion chambers of each of the second plurality of cylinders forming the second cylinder bank.

8. The marine outboard motor of claim 6, wherein the first plurality of cylinders and the second plurality of cylinders both consist of one of 2 and 3 cylinders each.

9. The marine outboard motor of claim 1, wherein the first angle is not greater than 90 degrees.

10. The marine outboard motor of claim 1, wherein the first angle is not greater than 74 degrees.

11. The marine outboard motor of claim 1, wherein each of the cylinder blocks, cylinder heads, pistons, connecting rods, intake ports and exhaust ports of the engine has the same configuration.

12. The marine outboard motor of claim 1, wherein the engine further comprises:

a third cylinder block connected to the crankcase on an opposite side of the engine from the first cylinder block and the second cylinder block, a third cylinder head connected to the third cylinder block, a third cylinder formed by the third cylinder block and the third cylinder head, a third piston reciprocally mounted within the third cylinder and forming a third variable volume combustion chamber, the third piston being connected to the crankshaft via a third connecting rod, at least one third intake port fluidly connected to the third combustion chamber for allowing at least one combustion component to enter the third combustion chamber, at least one third passage within the third cylinder block connecting the crankcase chamber with the at least one third intake port, at least one third exhaust port fluidly connected to the third combustion chamber for allowing spent combustion components to exit the third combustion chamber, the third cylinder having a third cylinder central axis, the third cylinder central axis being between a portion of the first plane and a portion of the second plane on a side of the engine on which the third cylinder block is located, and wherein the at least one combustion component is compressed in the crankcase chamber by the third piston before flowing through the at least one third passage and the at least one third intake port and entering the third combustion chamber.

13. The marine outboard motor of claim 12, wherein a third plane is defined by the third cylinder central axis and the crankshaft axis and the third plane is at a second angle to the first plane and at a third angle to the second plane, the second angle and the third angle being equal.

14. The marine outboard motor of claim 12, wherein the intake manifold is a first intake manifold; and further comprising a second intake manifold fluidly connected to the at least second intake port of the second combustion chamber of the second cylinder, and a third intake manifold fluidly connected to the at least third intake port of the third combustion chamber of the third cylinder.

15. The marine outboard motor of claim 14, wherein each of the first, second, and third intake manifolds of the engine have the same configuration.

16. The marine outboard motor of claim 12, wherein the valley is a first valley, and the exhaust manifold is a first exhaust manifold;

further comprising a second valley between the second and the third cylinders, a third valley between the third and the first cylinders, a second exhaust manifold fluidly connected to the at least second exhaust port of the second combustion chamber of the second cylinder, and a third exhaust manifold fluidly connected to the at least third exhaust port of the third combustion chamber of the third cylinder; and wherein each of the first, second and third valleys has only one of the first, second and third exhaust manifolds.

17. The marine outboard motor of claim 6, wherein the engine further comprises:

a third cylinder block connected to the crankcase on an opposite side of the engine from the first cylinder block and the second cylinder block, a third cylinder head connected to the third cylinder block, a third cylinder formed by the third cylinder block and the third cylinder head, a third piston reciprocally mounted within the third cylinder and forming a third variable volume combustion chamber, the third piston being connected to the crankshaft via a third connecting rod, at least one third intake port fluidly connected to the third combustion chamber for allowing at least one combustion component to enter the third combustion chamber, at least one third exhaust port fluidly connected to the third combustion chamber for allowing spent combustion components to exit the third combustion chamber, the third cylinder having a third cylinder central axis, the third cylinder central axis being between a portion of the first plane and a portion of the second plane on a side of the engine on which the third cylinder block is located, wherein the third cylinder is one of a third plurality of cylinders forming a third cylinder bank, each cylinder of the third cylinder bank having its cylinder central axis lying the third plane, the cylinders of the third cylinder bank being arranged in a third line parallel to the crankshaft axis.

18. The marine outboard motor of claim 17, wherein the first plurality of cylinders, the second plurality of cylinders and the third plurality of cylinders all consist one of 2 and 3 cylinders each.

* * * * *